US011292275B2

(12) United States Patent
Yamada et al.

(10) Patent No.: US 11,292,275 B2
(45) Date of Patent: Apr. 5, 2022

(54) PRINTING APPARATUS

(71) Applicant: SEIKO EPSON CORPORATION, Tokyo (JP)

(72) Inventors: Koji Yamada, Okaya (JP); Hiroaki Sakajo, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/923,917

(22) Filed: Jul. 8, 2020

(65) Prior Publication Data

US 2021/0008911 A1 Jan. 14, 2021

(30) Foreign Application Priority Data

Jul. 9, 2019 (JP) ..... JP2019-127469

(51) Int. Cl.
*B41J 29/377* (2006.01)

(52) U.S. Cl.
CPC ..... *B41J 29/377* (2013.01)

(58) Field of Classification Search
CPC ..... B41J 29/377
See application file for complete search history.

(56) References Cited

U.S. PATENT DOCUMENTS 5,887,226 A 3/1999 Taki
2011/0273860 A1* 11/2011 Corvese ..... B41J 29/02 361/816
2015/0146225 A1* 5/2015 Okada ..... H04N 1/00981 358/1.13

FOREIGN PATENT DOCUMENTS

JP H10-143053 5/1998

* cited by examiner

*Primary Examiner* — Jason S Uhlenhake
(74) *Attorney, Agent, or Firm* — Workman Nydegger

(57) ABSTRACT

A printing apparatus includes a power-supply unit, a printing unit, a circuit board (main wired board), and a cooling unit. The main-wired-board cooling unit includes: an inflow portion including an inlet from which air outside of a housing flows in, the inflow portion being disposed on a rear surface of the housing; a first flow path in which the air flowing in flows to a front surface side of the housing; a turn-around flow path causing the air flowing in the first flow path to be turned around to a rear surface side of the housing; a second flow path in which the air turned around flows to the rear surface side; a flow-out portion including an outlet from which the air flowing through the second flow path flows out to an outside of the housing, the out portion being disposed at the rear surface; and a fan (main fan) causing the air to flow in from the inlet and also causing the air passing through each of the flow paths to flow out from the outlet. The main wired board is disposed within the second flow path.

7 Claims, 9 Drawing Sheets

PRINTING APPARATUS

The present application is based on, and claims priority from JP Application Serial Number 2019-127469, filed on Jul. 9, 2019, the disclosure of which is hereby incorporated by reference herein in its entirety.

BACKGROUND

1. Technical Field

The disclosure relates to a printing apparatus.

2. Related Art

A printing apparatus that performs printing on a sheet has been disclosed. As disclosed in JP-A-10-143053, the disclosed printing apparatus includes a fan and an air inlet each provided on a side surface of an outer packaging case that forms the printing apparatus in order to perform cooling the inside of the printing apparatus. In addition, in the disclosure, as the fan is driven, the air outside of the printing apparatus is caused to enter the inside of the printing apparatus from the inlet provided on the side surface of the outer packaging case, thereby performing cooling.

However, in a case of JP-A-10-143053, the printing apparatus needs to be installed at a distance from a wall so as not to obstruct the inlet provided on the side surface of the printing apparatus. This results in a lack of a degree of flexibility in installation, which is disadvantage. Furthermore, the air entering from the inlet is configured to be blown directly onto the heat generating portion of the circuit board. This leads to a disadvantage in that, when air entering the inside of the printing apparatus contains electrically conductive dust such as iron dust, the electrically conductive dust may be attached to a terminal portion of a wired board element mounted on the circuit board, which causes malfunction such as circuit short.

SUMMARY

A printing apparatus includes, inside of a housing thereof: a power-supply unit configured to serve as a driving source; a printing unit configured to perform printing onto a sheet; a circuit board configured to drive the power-supply unit or the printing unit; and a cooling unit configured to cool the circuit board, wherein the cooling unit includes: an inflow portion including an inlet from which air outside of the housing flows in, the inflow portion being disposed at a rear surface of the housing; a first flow path in which the air flowing in from the inlet flows to a front surface side of the housing; a turn-around flow path causing the air flowing through the first flow path to be turned around to a rear surface side of the housing; a second flow path in which the air turned around in the turn-around flow path flows to the rear surface side; a flow-out portion including an outlet from which the air flowing through the second flow path flows out to an outside of the housing, the flow-out portion being disposed at the rear surface; and a fan causing the air to flow in from the inlet and also causing the air, which passes through the first flow path, the turn-around flow path, and the second flow path, to flow out from the outlet, wherein the circuit board is disposed within the second flow path.

In the printing apparatus described above, the first flow path and the second flow path may be separated from each other by a fixing member that fixes the circuit board.

In the printing apparatus described above, the fixing member may be formed of a metal member.

In the printing apparatus described above, a heat-dissipating fin may be formed at a surface of the fixing member at the first flow path side.

In the printing apparatus described above, the first flow path and the second flow path may be isolated from the printing unit provided inside the housing.

In the printing apparatus described above, the outlet may be provided at a position higher than a position of the inlet.

In the printing apparatus described above, the printed circuit may be a circuit board that configured to drive the printing unit, and the fan may be disposed an inner side of the rear surface in which the outlet is disposed.

In the printing apparatus described above, the circuit board may be a circuit board that constitutes the power-supply unit, and the fan may be disposed at a lower side of the circuit board, which is disposed in the second flow path, at the front face side.

DESCRIPTION OF EXEMPLARY EMBODIMENTS

1. Exemplary Embodiment

A printing apparatus 1 according to an exemplary embodiment of the present disclosure will be described with reference to the drawings.

In the present exemplary embodiment, the printing apparatus 1 is, for example, a printing apparatus configured to perform printing by feeding out a label sheet 101 serving as a sheet wound into a roll shape.

Figure 1:
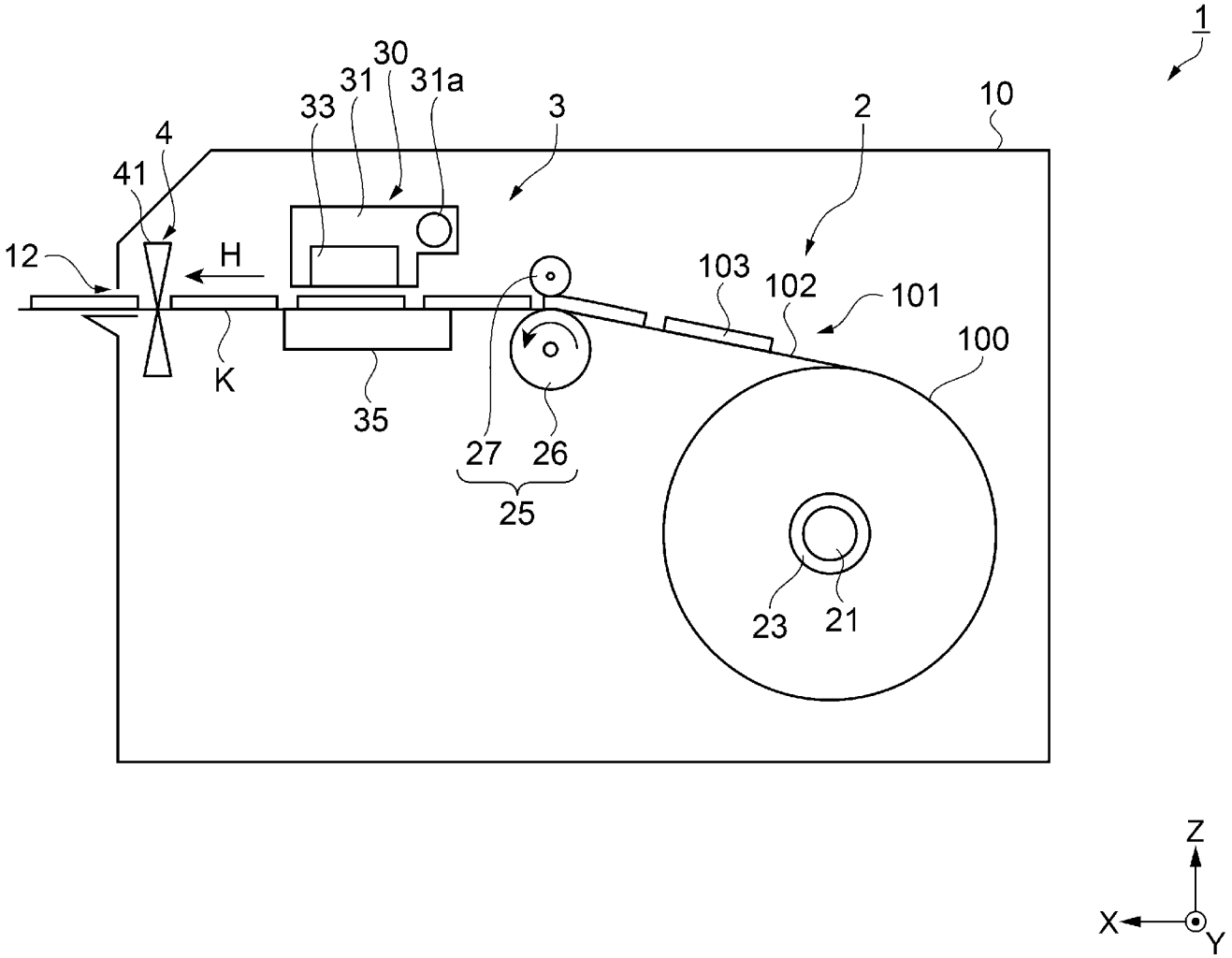
FIG. 1 is a cross-sectional view schematically illustrating a printing apparatus according to the present exemplary embodiment.
Figure 2:
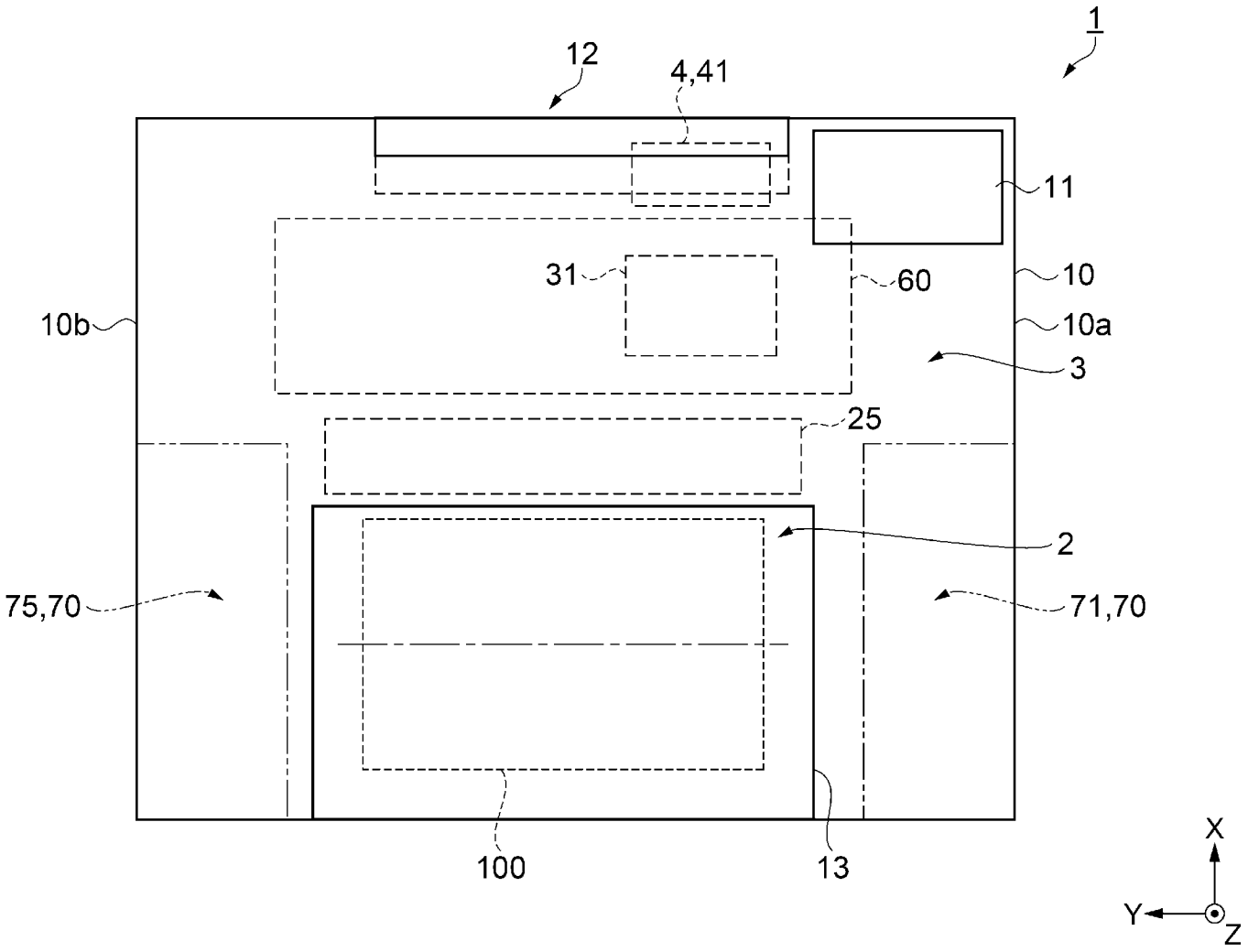
FIG. 2 is a top view illustrating an overview of a printing apparatus.

FIG. 1 is a cross-sectional view schematically illustrating the printing apparatus 1 according to the present exemplary embodiment. FIG. 2 is a top view illustrating an overview of the printing apparatus 1. Note that the drawings are each illustrated in various scales.

For the purpose of explanation, an XYZ coordinate system is employed by using, as a reference, a case where the printing apparatus 1 is placed on a horizontal plane. Specifically, the forward-rear direction of the printing apparatus 1 is set as the X direction; the forward direction or the front face side is set as the +X direction; and the rear direction or the rear face side is set as the −X direction. The left-right direction orthogonally with respect to the X direction of the printing apparatus 1 on the horizontal plane is set as the Y direction. The left direction or the left side when the printing apparatus 1 is viewed from the front face side is set as the −Y direction, and the right direction or the right side is set as the +Y direction. In addition, the direction running straightly with respect to the X direction and the Y direction of the printing apparatus 1, in other words, the direction orthogonal to the horizontal plane is set as the Z direction. The upper direction or the upper side is set as the +Z direction, and the lower direction (gravitational direction) or the lower side is set as the −Z direction. The directions are defined in this manner and are used in the following description as appropriate. Note that the Y direction corresponds to the width direction of the printing apparatus 1 and the label sheet 101.

The outline of the printing apparatus 1 will be described with reference to FIGS. 1 and 2.

The printing apparatus 1 according to the present exemplary embodiment prints an image and/or a character on a roll paper 100 (label sheet 101) in an ink-jet manner based on print data transmitted from an information processing device such as a personal computer and a mobile terminal (not illustrated).

As illustrated in FIGS. 1 and 2, the printing apparatus 1 includes a housing 10 having a substantially cuboid shape. As illustrated in FIG. 2, a display operation panel 11 is disposed on a front face of the housing 10, the display operation panel 11 including a display, an operation button, or the like disposed thereon. In addition, a discharge port 12 that causes the label sheet 101 to be discharged is provided at the center of the front face of the housing 10 in the width direction. Note that the label sheet 101 on which printing has been performed by the printing unit 3 is discharged from the discharge port 12. A roll paper 100 around which the label sheet 101 is wound is disposed in a center portion of the rear face side of the housing 10 in the width direction. As illustrated in FIG. 2, a roll paper cover 13 is disposed at the rear of and the center portion of the upper side of the housing 10 in the width direction, and opens at the time of installing or replacing the roll paper 100.

As illustrated in FIG. 1, the roll paper 100 is obtained by winding the label sheet 101 into a roll shape using, for example, a cylindrical paper tube 23 as a core. The label sheet 101 includes a base sheet 102 and a plurality of labels 103. The base sheet 102 is a continuous sheet formed in a band shape. The plurality of labels 103 is attached on the surface of the base sheet 102 at approximately equal intervals in the lengthwise direction of the base sheet 102. The label 103 is detachable from the base sheet 102.

As illustrated in FIG. 1, the printing apparatus 1 includes a transport path K formed therein. The transport path K serves as a path through which the label paper 101 is transported. The label sheet 101 fed from the roll paper 100 is transported in a transport direction H along the transport path K.

The printing apparatus 1 is configured to include a label-sheet feeding unit 2, a printing unit 3, and a cutting unit 4. As illustrated in FIG. 1, the label-sheet feeding unit 2 includes a roll-paper mounting portion 21. The paper tube 23 of the roll paper 100 is inserted into the roll-paper mounting portion 21 to be set in the roll-paper mounting portion 21 in a rotatable manner. With this configuration, the roll paper 100 rotates in association with rotation of the roll-paper mounting portion 21, which makes it possible to feed out the label sheet 101.

The printing unit 3 includes a sheet transport roller 25, a printing unit 30, and a platen 35. The sheet transport roller 25 is configured as a transport roller that sandwiches and transports the label sheet 101. The sheet transport roller 25 is disposed upstream of a printing head 33 in the transport direction H of the label sheet 101. The sheet transport roller 25 sandwiches the label sheet 101 to transport it toward the platen 35. Note that the printing apparatus 1 according to the present exemplary embodiment is a serial-type printing apparatus. Thus, the transport speed of the label sheet 101 is not constant, and the sheet transport roller 25 is intermittently driven by a first driving source described below. This results in the printing apparatus 1 intermittently transporting the label sheet 101 in the transport direction H.

The sheet transport roller 25 includes a sheet transport driving roller 26 and a sheet transport roller 27, each of which serves as a nip roller. The sheet transport driving roller 26 is driven to rotate by transmission of power from a drive source (not illustrated) having a feed motor or the like. A sheet transport driven roller 27 is brought into contact with the sheet transport driving roller 26 to be driven to rotate. Note that the sheet transport driving roller 26 and the sheet transport driven roller 27 are disposed in a direction intersecting the transport direction H.

The platen 35 and the printing unit 30 are provided downstream of the sheet transport roller 25. The platen 35 includes a plurality of suction holes (not illustrated) provided on an upper surface of the platen 35, and each of the suction holes communicates with a suction fan (not illustrated). This allows the label sheet 101 to be drawn onto the upper surface of the platen 35 and be transported, which prevents the label paper 101 from interfering with a nozzle surface (not illustrated) of the printing head 33.

The printing unit 30 includes a carriage 31 and the printing head 33 mounted on the carriage 31. The carriage 31 is supported by a carriage shaft 31*a* that extends in a main scanning direction (the width direction Y in the present exemplary embodiment) orthogonal to the transport direction H. The carriage 31 moves back and forth in the main scanning direction along the carriage shaft 31*a* to scan the printing head 33.

The printing head 33 is a serial-type inkjet head, and includes a nozzle row with a plurality of colors. The printing head 33 according to the present exemplary embodiment includes a nozzle row with four colors including cyan, yellow, magenta, and black. The print head 33 receives supply of ink from each ink cartridge, which is not illustrated, and ejects the ink from a nozzle provided in each nozzle row. The printing head 33 ejects the ink onto the label sheet 101 (label 103) on the platen 35 to print an image.

The printing unit 3 configured as described above alternately repeats a sub scanning and a main scanning, the sub scanning being configured such that the sheet transport roller 25 pulls the label sheet 101 from the roll paper 100 set at the roll-paper mounting portion 21 of the label-sheet feeding unit 2 to intermittently transport the label sheet 101 in the transport direction H, and the main scanning being configured such that the printing head 33 reciprocatingly moves in the width direction while ejecting ink onto the label sheet 101 (label 103). This makes it possible to print an image or character on the label sheet 101 (label 103). In other words, the printing unit 3 performs printing operation including the main scanning and the sub scanning to print an image or character on the label sheet 101 (label 103).

Note that the printed label sheet 101 (label 103) is further sent downstream in the transport direction H toward the cutting unit 4. The cutting unit 4 includes a cutter 41. The cutting unit 4 reciprocates in the width direction to cut, at a portion having a predetermined length, the base sheet 102 on which the printed label 103 is attached.

The base sheet 102 that has been cut and the label 103 are discharged from the discharge port 12. Note that a user picks up the base sheet 102 that has been cut and discharged from the discharge port 12, and detaches the printed label 103 by hand. The detached label 103 is attached to the application target by the user.

Figure 3:
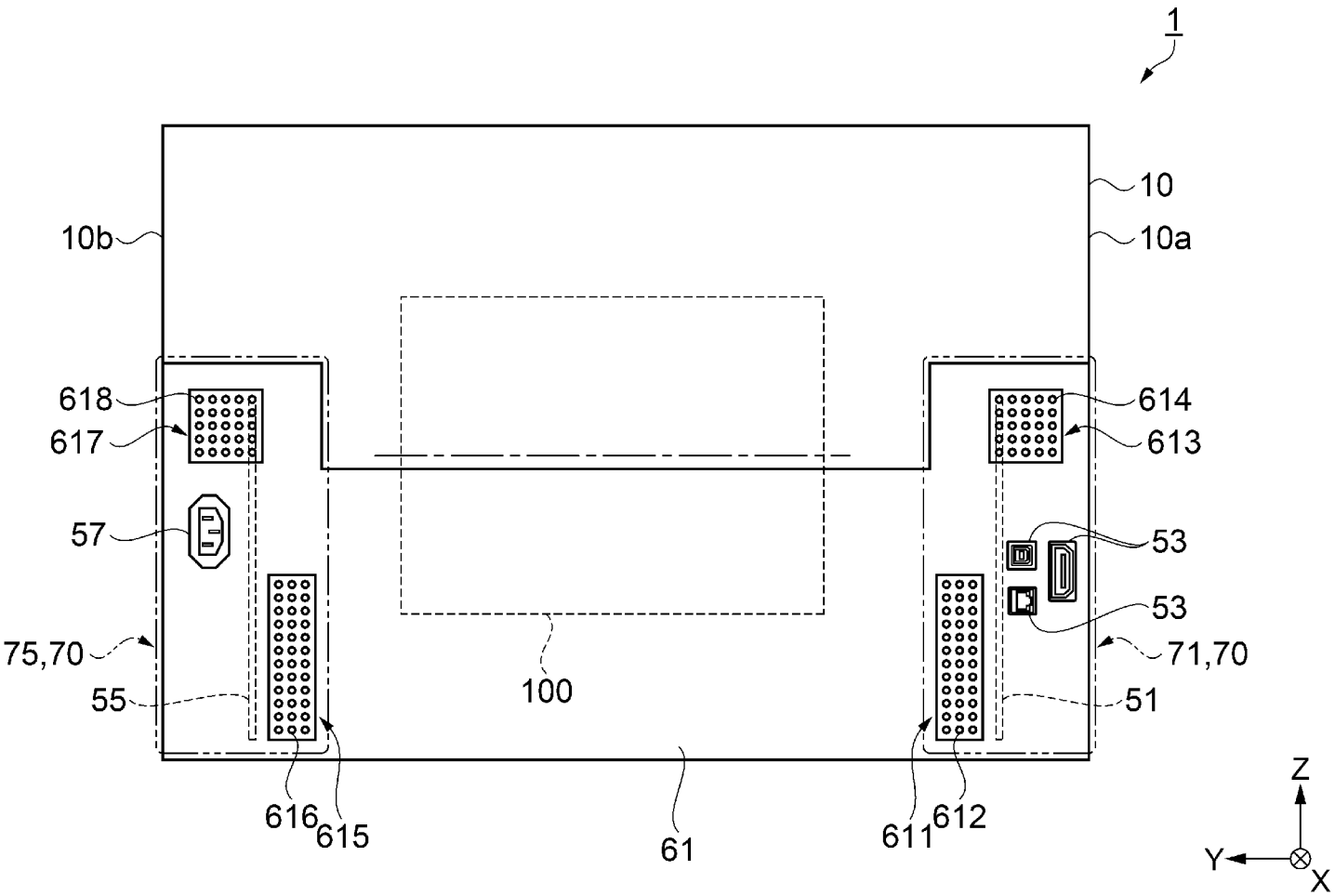
FIG. 3 is a rear view illustrating a state in which the printing apparatus is viewed from the rear side.
Figure 4:
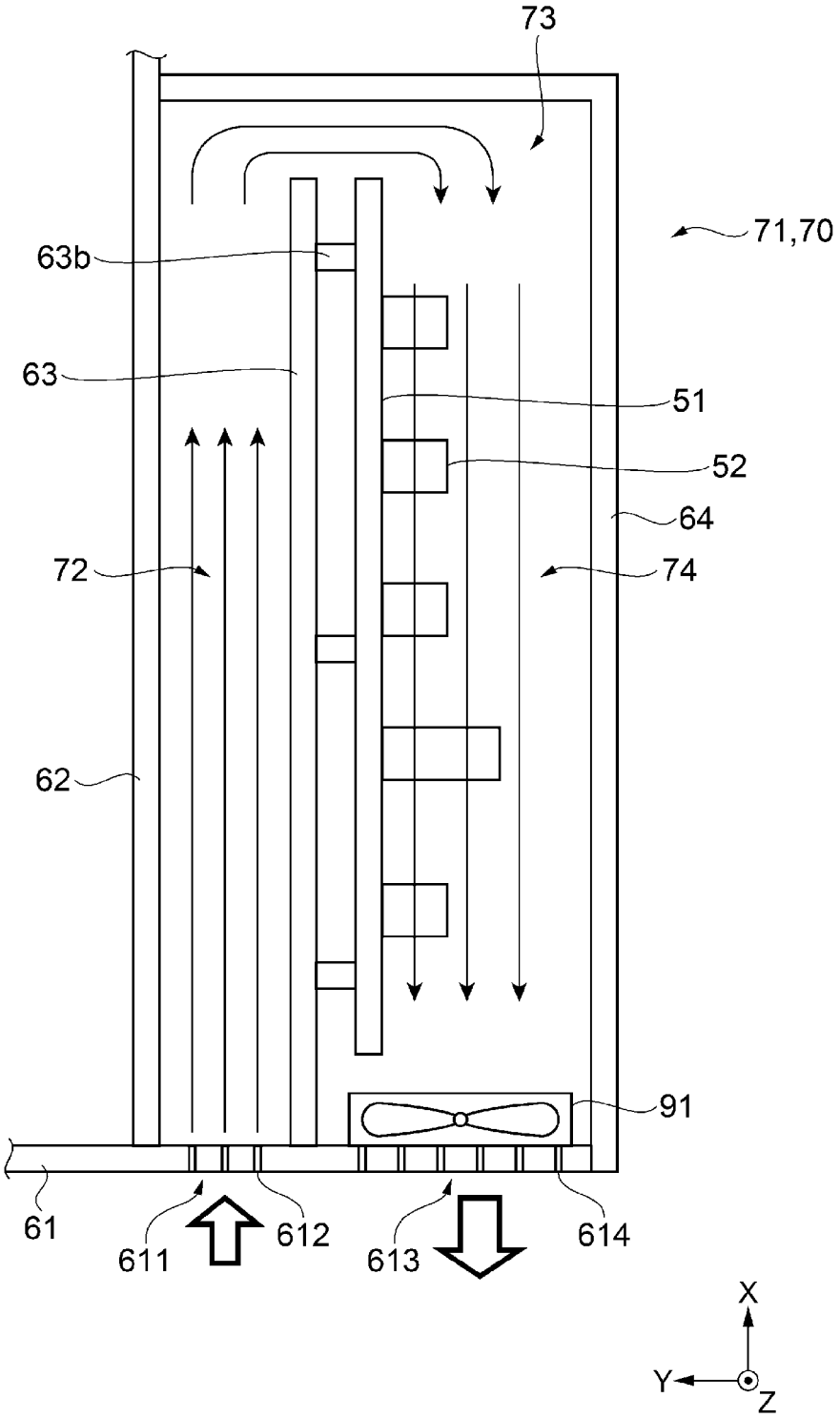
FIG. 4 is a cross-sectional view of a main-wired-board cooling unit as viewed from an upper side (+Z direction).
Figure 5:
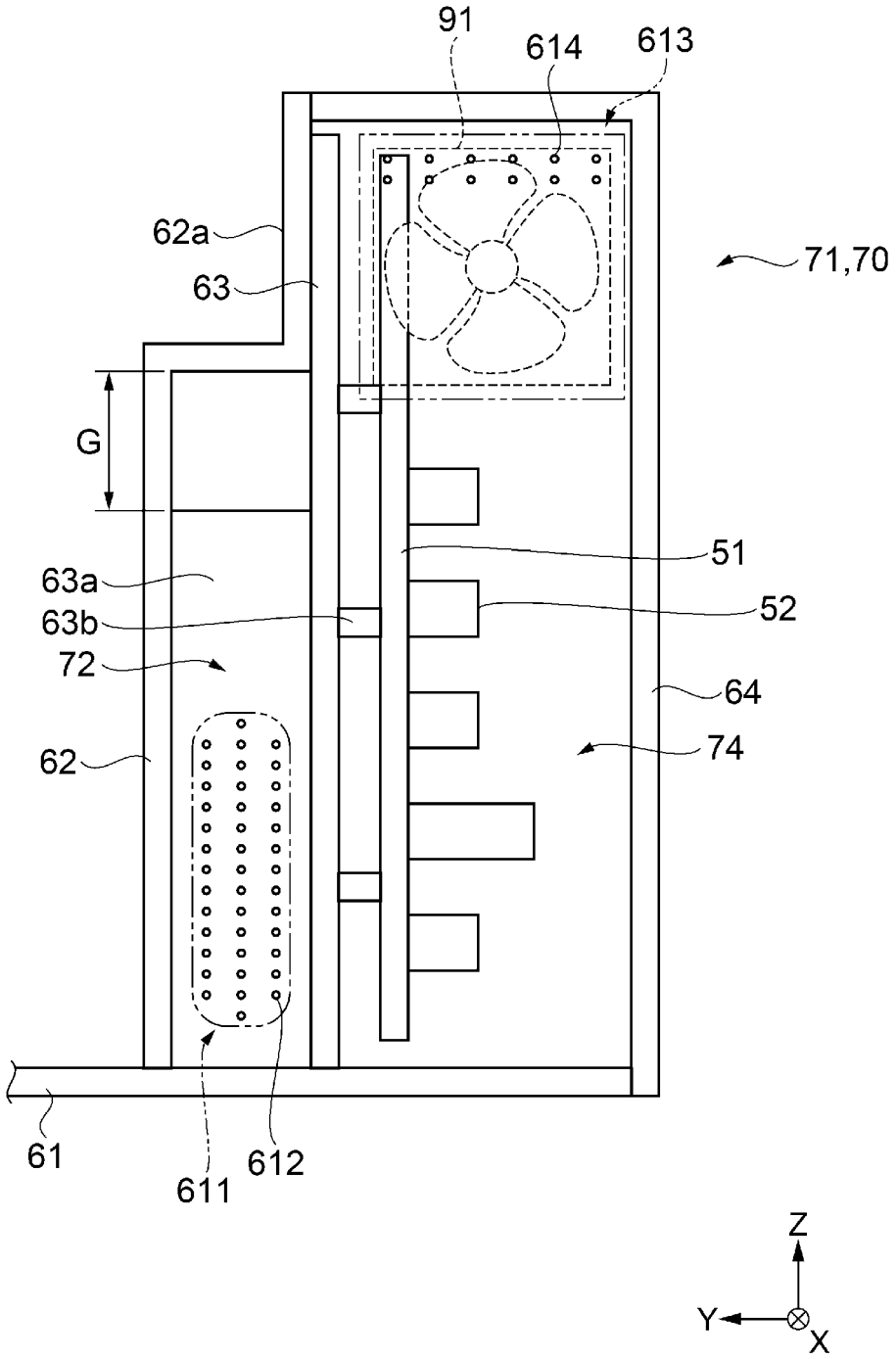
FIG. 5 is a cross-sectional view of the main-wired-board cooling unit as viewed from a rear face side (−X direction).
Figure 6:
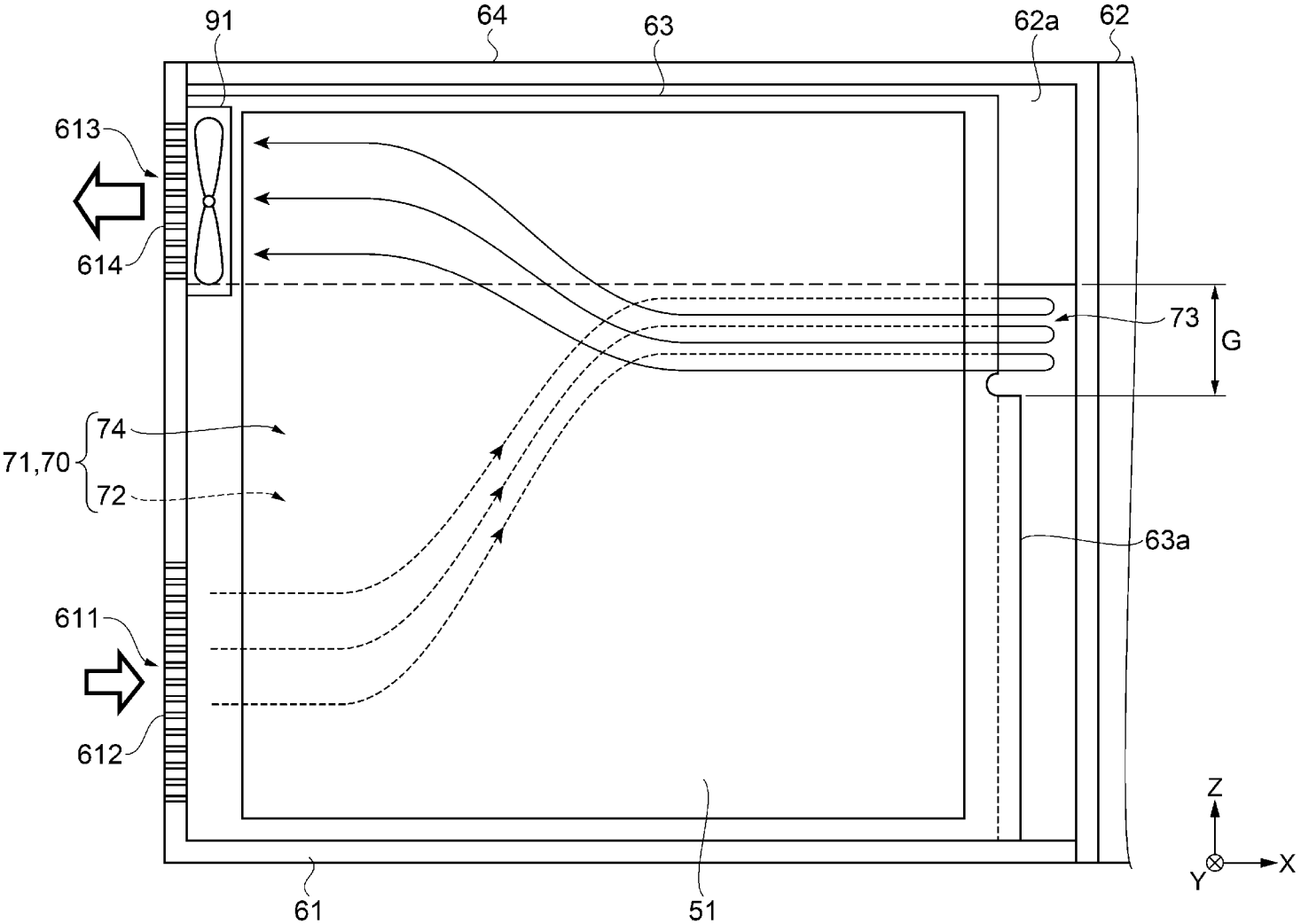
FIG. 6 is a cross-sectional view of the main-wired-board cooling unit as viewed from a left side (−Y direction).
Figure 7:
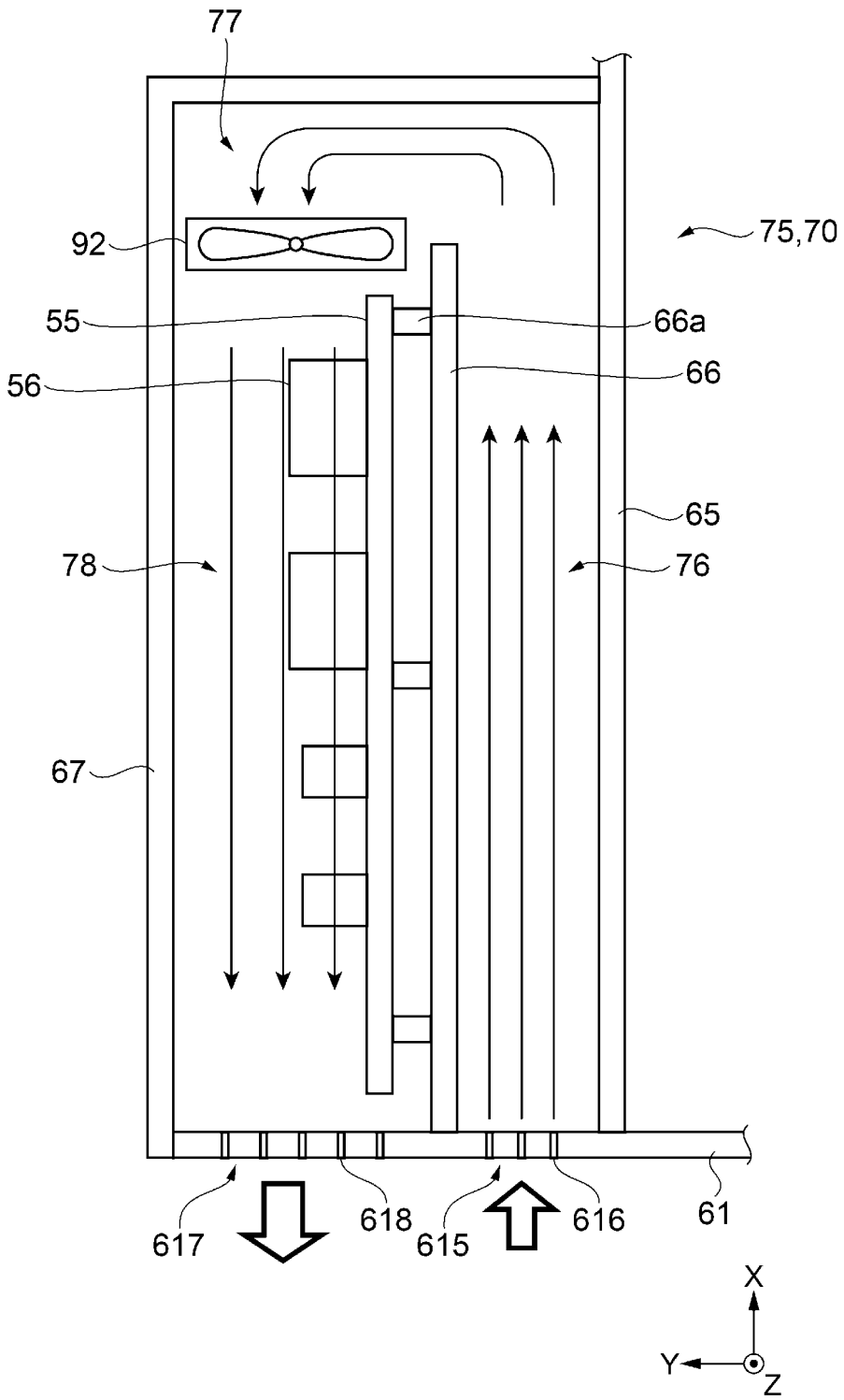
FIG. 7 is a cross-sectional view of a power-source-wired-board cooling unit as viewed from an upper side (+Z direction).
Figure 8:
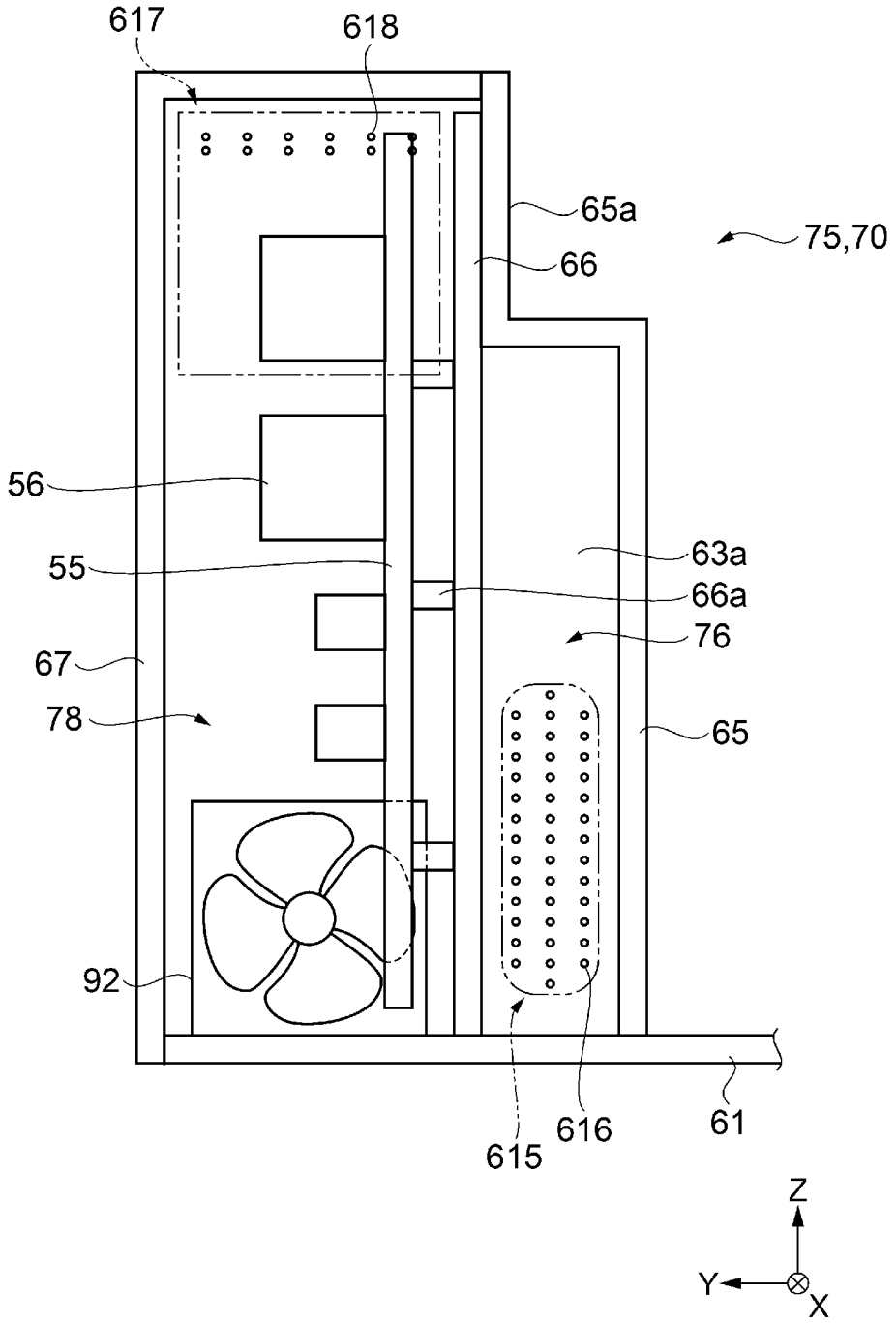
FIG. 8 is a cross-sectional view of the power-source-wired-board cooling unit as viewed from the rear face side (−X direction).
Figure 9:
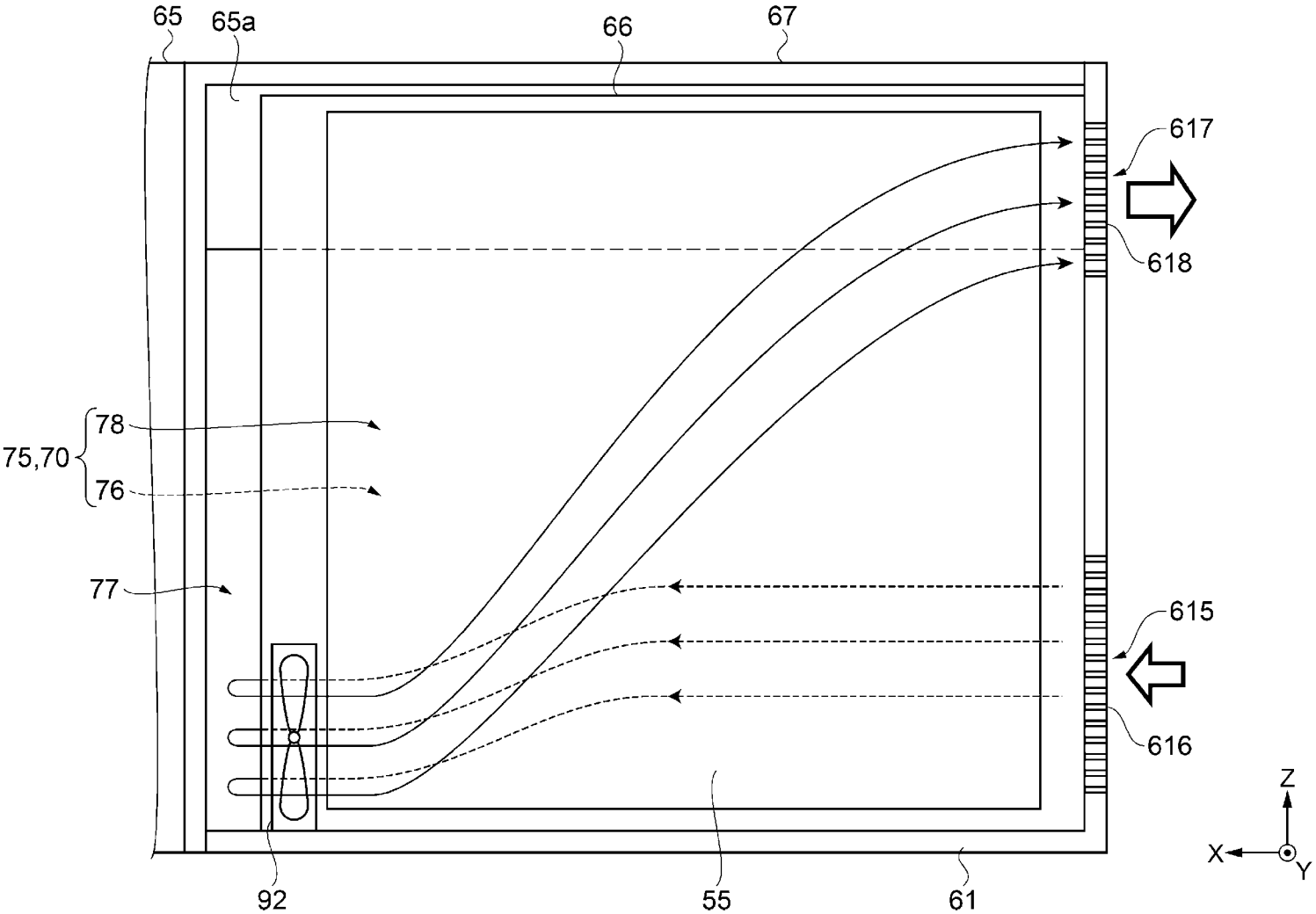
FIG. 9 is a cross-sectional view of the power-source-wired-board cooling unit as viewed from a right side (+Y direction).

FIG. 3 is a rear view illustrating a state in which the printing apparatus 1 is viewed from the rear side. FIG. 4 is a cross-sectional view of a main-wired-board cooling unit 71 as viewed from the upper side (+Z direction). FIG. 5 is a cross-sectional view of the main-wired-board cooling unit 71 as viewed from the rear face side (−X direction). FIG. 6 is a cross-sectional view of the main-wired-board cooling unit 71 as viewed from the left side (−Y direction). FIG. 7 is a cross-sectional view of a power-source-wired-board cooling unit 75 as viewed from the upper side (+Z direction). FIG. 8 is a cross-sectional view of the power-source-wired-board cooling unit 75 as viewed from the rear face side (−X direction). FIG. 9 is a cross-sectional view of the power-source-wired-board cooling unit 75 as viewed from the right side (+Y direction).

As illustrated in FIG. 2, a circuit board used to drive the printing apparatus 1 is provided inside side surface portions 10*a* and 10*b* on both sides of and on the rear face side (−X direction) of the printing apparatus 1 in the width direction, and a cooling unit 70 used to cool this circuit board is provided. In the case of the present exemplary embodiment, the circuit board generally includes two circuit boards: a main wired board 51 (see FIGS. 4 to 6) serving as a circuit board configured to include a control unit that controls the printing apparatus 1 in a centralized manner; and a power-supply wired board 55 (see FIGS. 7 to 9) serving as a circuit board that constitutes a power-supply unit serving as a driving source.

As illustrated in FIG. 3, the main wired board 51 is disposed inside the side surface portion 10*a* on the rear face side (−X direction) and on the left side (−Y direction) of the printing apparatus 1. In addition, as illustrated in FIGS. 4 to 6, the main wired board 51 includes various types of wired boards including a wired board used to drive the printing unit 3. Various types of wired board elements 52 are mounted on the main wired board 51. Similarly, as illustrated in FIG. 3, the power-supply wired board 55 is disposed inside the side surface portion 10*b* on the rear face side (−X direction) and on the right side (+Y direction) of the printing apparatus 1. In addition, as illustrated in FIGS. 7 to 9, various types of wired board elements 56 (see FIG. 7) that constitute the power-supply unit are mounted on the power-supply wired board 55.

Furthermore, as illustrated in FIG. 3, the main-wired-board cooling unit 71 used to cool the heat generated in the wired board element 52 of the main wired board 51 is formed inside the side surface portion 10*a* on the rear face side (−X direction) and on the left side (−Y direction) of the printing apparatus 1. Similarly, as illustrated in FIG. 3, the power-source-wired-board cooling unit 75 used to cool heat generated in the wired board elements 56 of the power-source wired board 55 is formed inside the side surface portion 10*b* on the rear face side (−X direction) and on the right side (+Y direction) of the printing apparatus 1. As described above, the cooling unit 70 according to the present exemplary embodiment includes the main-wired-board cooling unit 71 and the power-source-wired-board cooling unit 75.

Below, a configuration and operation of the main-wired-board cooling unit 71 that constitutes the cooling unit 70 will be described with reference to FIGS. 3 to 6.

As illustrated in FIG. 3, in the main-wired-board cooling unit 71, a USB port, an LAN port, or the like is disposed on the rear face side of the printing apparatus 1 and in a main case 61 that forms a flow path, which will be described later, of the main-wired-board cooling unit 71, thereby forming an interface unit 53 that allows connection with an information processing device such as a personal computer and a mobile terminal through various types of cables. Note that the interface unit 53 is electrically coupled to the main wired board 51 disposed inside. The main case 61 is a member that constitutes the rear face of the housing 10.

As illustrated in FIGS. 4 to 6, the main-wired-board cooling unit 71 includes a flow path used to take in external air and cause the external air to flow to perform cooling in order to cool the main wired board 51 installed inside. Note that the flow path is configured to be surrounded by the main case 61, a first case 62, a wired-board fixing case 63 serving as a fixing member, and a second case 64. Each of the cases is formed by pressing a metal plate that is to be a metal member, bending it, and the like.

The entire flow path of the main-wired-board cooling unit 71 is generally formed inside a substantially box-shaped hexahedron. In the hexahedron, the main case 61 constitutes a side surface on a rear face side (−X direction) and a side surface on the lower side (−Z direction). The first case 62 constitutes a side surface on the right side (+Y direction). The second case 64 constitutes a side surface on the left side (−Y direction), a side surface on the front face side (+X direction), and a side surface on the upper side (+Z direction). In addition, the wired-board fixing case 63 having a rectangular shape is disposed in a space surrounded by the main case 61, the first case 62, and the second case 64. This configures each flow path of the main-wired-board cooling unit 71.

The arrangement of the wired-board fixing case 63 will be described.

As illustrated in FIGS. 4 and 5, the wired-board fixing case 63 is disposed in parallel to the X-Z plane within the main-wired-board cooling unit 71. Specifically, the wired-board fixing case 63 is disposed at a position of the side surface of the main case 61 on the rear face side (−X direction), the position being slightly shifted, in the Y direction, to the first case 62 from the center between the first case 62 and the second case 64.

The wired-board fixing case 63 has an end surface on the rear face side that is in contact with a side surface of the main case 61 on the rear face side, and also has an end surface on the lower side that is in contact with a side surface of the main case 61 on the lower side. In addition, as illustrated in FIG. 5, a right side surface of the upper side of the wired-board fixing case 63 is in contact with a side surface 62*a* formed by bending, in a one-step manner, the side surface of the upper side of the first case 62 in the left direction along the X direction.

Furthermore, as illustrated in FIGS. 4 and 6, the end surface of the wired-board fixing case 63 on the front face side is spaced apart from the opposing side surface of the second case 64 on the front face side. In addition, as illustrated in FIGS. 5 and 6, the end surface of the wired-board fixing case 63 on the front face side is configured such that a side surface 63*a* bent toward the right side (+Y direction) is in contact with a side surface of the first case 62 on the right side, with a space G being provided to be opened at a lower side of the side surface 62*a* of the contacting first case 62. Note that, in the present exemplary embodiment, air does not leak at portions that are in contact with each other described above.

The flow paths that constitute the main-wired-board cooling unit 71 will be described.

The main-wired-board cooling unit 71 includes a first flow path 72, a turn-around flow path 73, and a second flow path 74. The first flow path 72 is configured to be surrounded by: the main case 61 serving as the side surface on the rear face side and the side surface on the lower side; the first case 62 serving as the side surface on the right side; the wired-board fixing case 63; and the second case 64 serving as the side surface on the upper side. The second flow path 74 is configured to be surrounded by: the main case 61 serving as a side surface on the rear face side and a side surface on the lower side; the wired-board fixing case 63; and the second case 64 serving as a side surface on the left side and a side surface on the upper side.

The first flow path 72 and the second flow path 74 are separated by the wired-board fixing case 63 that fixes the main wired board 51. With such a configuration, the first flow path 72 and the second flow path 74 are separated from the printing unit 3 provided inside the housing 10. Note that, in connection with cables used to couple the main wired board 51 to each of the driving units such as the printing unit 3, a cushion member or the like is provided between the cables and an insertion hole provided in each of the cases that constitute the main-wired-board cooling unit 71, and the cables run from the main-wired-board cooling unit 71 through the insertion hole. In this way, the gap between the insertion hole and the cable is filled with the cushioning material or the like to achieve a configuration in which heat generated in the main wired board 51 is prevented from being transferred to the printing portion 3.

The turn-around flow path 73 is configured to include: an end surface of the wired-board fixing case 63 on the front face side; the second case 64 opposed to and spaced apart from this end surface on the front face side, this second case 64 serving as a side surface on the front face side; and each of the cases that surround the up-down and left-right directions. Note that the turn-around flow path 73 serves as a flow path that couples the first flow path 72 and the second flow path 74. The first flow path 72 and the turn-around flow path 73 communicate through the gap G.

The first flow path 72 is a flow path that causes the external air to flow in, and also to flow. As illustrated in FIGS. 3 to 6, an inflow portion 611 is formed in the side surface of the main case 61 on the rear face side, this side surface corresponding to the first flow path 72. The inflow portion 611 is configured in a form in which the inflow portion 611 extends in the Z direction in the lower portion of the main case 61. A plurality of inlets 612 from which the external air flows into the first flow path 72 is formed in the inflow portion 611. In the first flow path 72, the air flowing in from the inflow port 612 on the rear face side flows to the front face side. Note that, in a case of the present exemplary embodiment, there is nothing, within the first flow path 72, that blocks the flow of the air.

The turn-around flow path 73 is a flow path that causes the air flowing in from the rear face side and then flowing on the front face side of the first flow path 72, to be turned around toward the rear face side and flow to the second flow path 74. As illustrated in FIGS. 3 to 6, a plurality of protrusion portions 63*b* that fix the main wired board 51 is formed on the left side surface of the wired-board fixing case 63. Within the second flow path 74, the main wired board 51 is fixed to the protrusion portions 63*b* of the wired-board fixing case 63 so as to be in parallel to the X-Z plane.

Note that, of the wired board element 52 mounted on the main wired board 51, an element having a height higher than the protrusion portions 63*b* is mounted on the left side surface (−Y direction) of the main wired board 51. In addition, of the wired board elements 52 mounted on the main wired board 51, a wired board element 52 that constitutes a driving circuit used to drive a printing head 33 having the greatest heat generation is disposed in a region of the main wired board 51 near the gap G.

The second flow path 74 is a flow path in which the air turned around in the turn-around flow path 73 flows on the rear face side so as to flow out to the outside of the printing apparatus 1. In addition, the second flow path 74 is a flow path in which the air flows to cool the wired board element 52 mounted on the main wired board 51 and also cool the heat generated.

As illustrated in FIGS. 3 to 6, a flow-out portion 613 is formed in the side surface of the main case 61 on the rear face side, this side surface corresponding to the second flow path 74. The flow-out portion 613 is formed in an upper portion of the main case 61. In other words, the flow-out portion 613 is disposed at a position higher than the inflow portion 611. A plurality of outlets 614 from which the air flowing through the second flow path 74 flows out to the outside is formed in the flow-out portion 613. Thus, the outlets 614 are provided at a position higher than the inlet 612.

In the present exemplary embodiment, the main wired board 51 serving as a target of cooling is disposed inside the second flow path 74, as described above. In addition, a main fan 91 is disposed inside the surface of the main case 61 so as to face the outlet 614. In other words, the main fan 91 is disposed inside the main case 61 that constitutes the rear face side where the outlet 614 is provided. The main fan 91 causes air serving as external air to flow in from the inlet 612, and also causes the air passing through the first flow path 72, the turn-around flow path 73, and the second flow path 74 to flow out from the outlet 614. In the present exemplary embodiment, the main fan 91 uses a so-called axial fan having a structure in which air taken in from a direction of the rotational axis of the fan is discharged in the same direction. Note that the outflow port 614 is provided at a position higher than the inlet 612.

The operation of the main-wired-board cooling unit 71 will be described.

As illustrated in FIGS. 4 and 6, when the main fan 91 starts to be driven by the control unit, air serving as the external air flows into the first flow path 72 through the inlet 612 on the rear face side. Air that has entered the first flow path 72 flows toward the front face side in the first flow path 72 while flowing toward the gap G because the front face side is closed by the side surface 63*a* of the wired-board fixing case 63.

In the present exemplary embodiment, when air entering the first flow path 72 contains dust having electrical conductivity such as iron dust, heavy dust such as iron dust falls in the first flow channel 72 during the flow, thereby suppressing the adherence of the electrically conductive dust in the air to the wired board elements 52 mounted on the second flow path 74. Hereinafter, the "electrically conductive dust" represents the "dust having electrical conductivity such as iron dust".

The air flowing through the first flow path 72 flows into the turn-around flow path 73 through the gap G. Then, the air hits against the side surface of the second case 64 on the front face side to be turned around toward the second flow path 74 side. The air flowing through the first flow path 72 flows through the gap G where the opening area narrows, so that the air flows at an increased speed, and then, is turned around. Thus, the air at an increased speed flows through the wired board element 52 disposed in the region in the vicinity of the gap G of the main wired board 51. This makes it possible to improve efficiency of cooling the wired board element 52 (wired board element 52 that constitutes a driving circuit that causes the printing head 33 to drive) disposed in the vicinity of the gap G and having the greatest heat generated in the main wired board 51.

As illustrated in FIGS. 4 and 6, the air that has been turned around in the turn-around flow path 73 flows through the second flow path 74. As the air flows through the second flow path 74, the heat generated in the wired board element 52 mounted on the main wired board 51 is removed. Then, the air heated as a result of removing the heat generated in the wired board element 52 is drawn by the main fan 91, and flows out to the outside of the printing apparatus 1 through the outlet 614. The operation described above cools the wired board element 52 that is mounted on the main wired board 51 and causes the printing head 33 to drive, and also cools other wired board elements 52.

In this case, since warmed air typically moves upward, the wired board element 52 that drives the printing head 33 having the greatest heat generated in the main wired board 51 is disposed in a region of the gap G located on the upper side of the second flow path 74. This causes the flowing air to flow at an increased speed, and also causes the air to flow toward the outlet 614 formed on the upper side. This configuration prevents the warmed air from warming other wired board elements 52.

Below, the configuration and operation of the power-source-wired-board cooling unit 75 that constitutes the cooling unit 70 will be described with reference to FIG. 3 and FIGS. 7 to 9.

As illustrated in FIG. 3, in the power-source-wired-board cooling unit 75, an inlet connector 57 is disposed on the rear face side of the printing apparatus 1 and in the main case 61 that constitutes a flow path, which will be described later, of the power-source-wired-board cooling unit 75. With the inlet connector 57 being coupled to a power supply cable (not illustrated), commercial electric power is supplied. The inlet connector 57 is electrically coupled to the power-source wired board 55 disposed inside.

As illustrated in FIGS. 7 to 9, the power-source-wired-board cooling unit 75 includes a flow path used to take in external air and cause the external air to flow to perform cooling in order to cool the power-source wired board 55 disposed inside. Note that the flow path is configured to be surrounded by the main case 61, the first case 65, the wired-board fixing case 66 serving as a fixing member, and the second case 67. Each of the cases is formed by pressing a metal plate that is to be a metal member, bending it, and the like.

The entire flow path of the power-source-wired-board cooling unit 75 is generally formed inside a box-shaped hexahedron. In the hexahedron, the main case 61 constitutes a side surface on a rear face side (−X direction) and a side surface on the lower side (−Z direction). The first case 65 constitutes a side surface on the left side (−Y direction). The second case 67 constitutes a side surface on the right side (+Y direction), a side surface on the front face side (+X direction), and a side surface on the upper side (+Z direction). In addition, the wired-board fixing case 66 having a rectangular shape is disposed in an interior space surrounded by the main case 61, the first case 65, and the second case 67. This configures each of the flow paths of the power-source-wired-board cooling unit 75.

The arrangement of the wired-board fixing case 66 will be described.

As illustrated in FIGS. 7 and 8, the wired-board fixing case 66 is disposed in parallel to the X-Z plane within the power-source-wired-board cooling unit 75. Specifically, the wired-board fixing case 66 is disposed at a position of the side surface of the main case 61 on the rear face side (−X direction), the position being slightly shifted, in the Y direction, to the first case 65 from the center between the first case 65 and the second case 67.

The wired-board fixing case 66 has an end surface on the rear face side that is in contact with the side surface of the main case 61 on the rear face side, and also has an end surface on the lower side that is in contact with the side surface of the main case 61 on the lower side. In addition, as illustrated in FIG. 8, a left side surface of the upper side of the wired-board fixing case 66 is in contact with a side surface 65*a* formed by bending, in a one-step manner, the side surface of the upper side of the first case 65 in the right direction along the X direction. Note that, in the present exemplary embodiment, air does not leak at portions that are in contact with each other described above. As illustrated in FIGS. 7 and 9, the end surface of the wired-board fixing case 66 on the front face side is spaced apart from the opposing side surface of the second case 67 on the front face side.

The flow path that constitutes the power-source-wired-board cooling unit 75 will be described.

The power-source-wired-board cooling unit 75 includes a first flow path 76, a turn-around flow path 77, and a second flow path 78. The first flow path 76 is configured to be surrounded by the main case 61 serving as a side surface on the rear face side as well as the side surface on the lower side, the first case 65 serving as the side surface on the left side, the wired-board fixing case 66, and the second case 67 serving as the side surface on the upper side. The second flow path 78 is configured to be surrounded by the main case 61 serving as a side surface on the rear face side as well as the side surface on the lower end, the wired-board fixing case 66, and the second case 67 serving as the side surface on the right side as well as the side surface on the upper side.

The first flow path 76 and the second flow path 78 are separated by the wired-board fixing case 66 that fixes the power-source wired board 55. With such a configuration, the first flow path 76 and the second flow path 78 are isolated from the printing unit 3 provided inside the housing 10.

The turn-around flow path 77 includes: an end surface of the wired-board fixing case 66 on the front face side; the second case 67 opposed to and spaced apart from this end surface on the front face side, this second case 67 serving as a side surface on the front face side; and each of the cases that surround the up-down and left-right directions. Note that the turn-around flow path 77 serves as a flow path that couples the first flow path 76 and the second flow path 78 and allows these paths to communicate each other.

The first flow path 76 is a flow path in which external air flows in, and also flows through. As illustrated in FIG. 3 and FIGS. 7 to 9, the inflow portion 615 is formed on the side surface of the main case 61 on the rear face side, this side surface corresponding to the first flow channel 76. The inflow portion 615 is configured in a form in which it extends in the Z direction in the lower portion of the main case 61. A plurality of inlets 616 from which the external air flows into the first flow path 76 is formed in the inflow portion 615. In the first flow path 76, the air flowing in from the inflow port 616 on the rear face side flows to the front face side. Note that, in the present exemplary embodiment, there is nothing, within the first flow path 76, that blocks the flow of the air.

The turn-around flow path 77 is a flow path that causes the air flowing in from the rear face side and then flowing on the front face side of the first flow path 76, to be turned around toward the rear face side and flow to the second flow path 78. As illustrated in FIG. 3 and FIGS. 7 to 9, a plurality of protrusion portions 66*a* that fix the power-source wired board 55 is formed on the right side surface of the wired-board fixing case 66. Within the second flow path 78, the power-source wired board 55 is fixed to the protrusion portions 66*a* of the wired-board fixing case 66 so as to be in parallel to the X-Z plane. Note that, of the wired board element 56 mounted on the power-source wired board 55, an element having a height higher than the height of the protrusion portions 66*a* is mounted on the right side face (+Y direction) of the power-source wired board 55.

The second flow path 78 is a flow path in which the air turned around in the turn-around flow path 77 flows on the rear face side so as to flow out to the outside of the printing apparatus 1. In addition, the second flow path 78 is a flow path in which air flows, thereby cooling the wired board element 56 mounted on the power-source wired board 55 and also cooling the heat generated.

As illustrated in FIG. 3 and FIGS. 7 to 9, an flow-out portion 617 is formed in the side surface of the main case 61 on the rear face side, this side surface corresponding to the second flow path 78. The flow-out portion 617 is formed in the upper portion of the main case 61. In other words, the flow-out portion 617 is disposed at a position higher than the inflow portion 615. A plurality of outlets 618 that cause the air flowing through the second flow path 78 to flow out to the outside is formed in the flow-out portion 617. Thus, the outlets 618 are provided at a position higher than the inlet 616.

In the present exemplary embodiment, the power-source wired board 55 serving as the target of cooling is disposed within the second flow path 78, as described above. In addition, a power supply fan 92 is disposed at a side surface of the main case 61 on the lower side, which is located on the lower side of an area where the second flow path 78 starts, the power supply fan 92 being provided so as to face the inner surface of the second case 67 on the front face side. In other words, the power supply fan 92 is disposed on the lower side of the front face side of the power-source wired board 55 disposed within the second flow path 78. The power supply fan 92 causes air serving as external air to flow in from the inlet 616, and also causes the air passing through the first flow path 76, the turn-around flow path 77, and the second flow path 78 to flow out from the outlet 618. In the present exemplary embodiment, the power supply fan 92 uses an axial fan, as with the main fan 91.

The operation of the power-source-wired-board cooling unit 75 will be described.

As illustrated in FIGS. 7 and 9, when the power supply fan 92 starts to be driven by the control unit, air serving as the external air flows into the first flow path 76 through the inlet 616 on the rear face side. The air that has entered the first flow path 76 flows toward the front face side in the first flow path 76. In the present exemplary embodiment, when air entering the first flow path 76 contains dust having electrical conductivity such as iron dust, the dust falls in the first flow path 76 during the flow, thereby suppressing the adherence of the electrically conductive dust in the air to the wired board element 56 disposed in the second flow path 78.

The air flowing through the first flow path 76 flows into the turn-around flow path 77. Then, the air hits against the side surface of the second case 67 on the front face side to be turned around toward the second flow path 78 side. The air turned around in the turned-around flow path 77 is drawn by the power supply fan 92 and is blown into the second flow path 78, as illustrated in FIG. 9. The power supply fan 92 is disposed in the lower portion of the second flow path 78. Thus, the air blown from the power supply fan 92 flows from the lower portion toward the upper portion where the outlet 618 is formed. As the air flows from the lower portion in the second flow path 78 toward the upper portion where the outlet 618 is formed, the air flows diagonally from the lower portion on the front face side toward the upper portion on the rear face side with respect to the power-source wired board 55.

The air flowing as described above removes the heat generated in the entire wired board element 56 mounted on the power-source wired board 55. Then, the air warmed as a result of removal of the heat generated in the wired board element 56 flows out to the outside of the printing apparatus 1 through the outlet 618. Note that warmed air typically moves upward. Thus, the power supply fan 92 is disposed in the lower portion of the second flow path 78, and the air blown from the power supply fan 92 is caused to flow from the lower portion toward the upper portion where the outlet 618 is formed, which makes it further easier for the warmed air to flow out from the outlet 618. With the operation described above, the wired board element 56 mounted on the power-source wired board 55 is cooled.

According to the present exemplary embodiments, it is possible to obtain the following effects.

In the printing apparatus 1 according to the present exemplary embodiment, the main-wired-board cooling unit 71 that constitutes the cooling unit 70 includes, in the main case 61 serving as the rear face side of the housing 10: the inflow portion 611 including the inlet 612; and the flow-out portion 613 including the outlet 614. In addition, there are provided: the first flow path 72 in which air flowing in from the inlet 612 flows on the front face side; the turn-around flow path 73 that causes the air flowing in the first flow path 72 to be turned around to the rear face side; and the second flow path 74 in which the air turned around in the turn-around flow path 73 flows on the rear face side. Furthermore, there is provided the main fan 91 that causes air to flow in from the inlet 612 and also causes the air passing through the first flow path 72, the turn-around flow path 73, and the second flow path 74 to flow out from the outlet 614.

Moreover, similarly, the power-source-wired-board cooling unit 75 includes, in the main case 61 serving as the rear face side of the housing 10: the inflow portion 615 including the inlet 616; and the flow-out portion 617 including the outlet 618. In addition, there are provided: the first flow path 76 in which air flowing in from the inlet 616 flows on the front face side; the turn-around flow path 77 that causes the air flowing in the first flow path 76 to be turned around to the rear face side; and the second flow path 78 in which the air turned around in the turn-around flow path 77 flows on the rear face side. Furthermore, there is provided the power supply fan 92 that causes air to flow in from the inlet 616, and also causes the air passing through the first flow path 76, the turn-around flow path 77, and the second flow path 78 to flow out from the outlet 618.

With the main-wired-board cooling unit 71 and the power-source-wired-board cooling unit 75 configured as described above, it is possible to cool the main wired board 51 and the power-source wired board 55 of the printing apparatus 1. Thus, when the printing apparatus 1 is installed on a shelf, it is possible to perform installation in a state where the printing apparatus 1 is in contact with a side surface of the shelf located in the left-right direction. This makes it possible to minimize the installation space, thereby improving the degree of freedom in terms of installation, as compared to typical printing apparatuses in which an inlet is provided in a side surface of the main body of the apparatus, and when the printing apparatus is installed on a shelf, there is a constraint in which the printing apparatus needs to be installed so as to be spaced apart from the side wall of the shelf, for example.

Note that a small space needs to be given on the rear face side in order to allow a power supply cable or various types of cables to be installed. Cooling, however, can be performed using this open space.

In the printing apparatus 1 according to the present exemplary embodiment, the main-wired-board cooling unit 71 is configured such that the first flow path 72 on the inlet 612 side and the second flow path 74 on the outlet 614 side communicate to each other through the turn-around flow path 73 in a turned-around manner. In addition, the main wired board 51 is disposed inside the second flow path 74.

Similarly, the power-source-wired-board cooling unit 75 is configured such that the first flow path 76 on the inlet 616 side and the second flow path 78 on the outlet 618 side communicate to each other through the turn-around flow path 77 in a turned-around manner. In addition, the power-source wired board 55 is disposed inside the second flow path 78.

With the main-wired-board cooling unit 71 and the power-source-wired-board cooling unit 75 configured as described above, it is possible to cause electrically conductive heavy dust such as iron dust to fall down in the first flow paths 72 and 76 before turned around even when the entering air contains electrically conductive dust. Thus, the electrically conductive dust is less likely to flow through the main wired board 51 or the power-source wired board 55 disposed in the second flow path 74, 78. This makes it possible to suppress occurrence of malfunction of circuits such as circuit short due to attachment of electrically conductive dust, as compared with typical printing apparatuses in which malfunction occurs in circuits due to attachment of electrically conductive dust because air flowing in from an inlet is directly blown onto the circuit board to perform cooling.

In the printing apparatus 1 according to the present exemplary embodiment, the main-wired-board cooling unit 71 is configured such that the first flow path 72 and the second flow path 74 are separated by the wired-board fixing case 63 that fixes the main wired board 51. Similarly, the power-source-wired-board cooling unit 75 is configured such that the first flow path 76 and the second flow path 78 are separated by the wired-board fixing case 66 that fixes the power-source wired board 55.

With this configuration, it is possible to simply configure the first flow path and the second flow path using a simple member of the wired-board fixing case 63, 66 between the first flow path 72 and the second flow path 74 as well as between the first flow path 76 and the second flow path 78. Thus, it is possible to configure the main-wired-board cooling unit 71 and the power-source-wired-board cooling unit 75 in a compact manner.

In the printing apparatus 1 according to the present exemplary embodiment, the wired-board fixing cases 63 and 66 include a metal member. This allows part of the heat generated in the main wired board 51 and the power-source wired board 55 to be transferred to the wired-board fixing case 63, 66 and be dissipated using the air flowing through the first flow path 72, 76, which makes it possible to improve efficiency of cooling the main wired board 51 and the power-source wired board 55.

In the printing apparatus 1 according to the present exemplary embodiment, the first flow path 72 and the second flow path 74 are isolated from the printing unit 3 provided inside the housing 10. In addition, the first flow path 76 and the second flow path 78 are isolated from the printing unit 3 provided inside the housing 10. Thus, the heat generated in the main wired board 51 and the power-source wired board 55 is not transferred to the printing unit 3. This makes it possible to prevent the printing unit 3 from receiving an effect of heat, which makes it possible to maintain printing quality. In addition, it is possible to prevent a mist that is more likely to be generated during printing, from being attached to the main wired board 51 or the power-source wired board 55.

In the printing apparatus 1 according to the present exemplary embodiment, the outlet 614 that constitutes the main-wired-board cooling unit 71 is provided at a position higher than the inlet 612. Similarly, the outlet 618 that constitutes the power-source-wired-board cooling unit 75 is provided at a position higher than the inlet 616. Note that warmed air moves upward. Thus, with the outlets 614 and 618 being provided at positions higher than the inlets 612 and 616, it is possible to easily cause the warmed air to flow out from the outlets 614 and 618.

In the main-wired-board cooling unit 71 of the printing apparatus 1 according to the present exemplary embodiment, the main-wired-board cooling unit 51 includes a circuit that causes the printing unit 3 to drive. The main fan 91 is provided inside the rear face where the outlet 614 is provided. In this manner, the main fan 91 is provided so as to correspond to the main wired board 51 that causes the printing unit 3 to drive. Thus, it is possible to set the inside of the flow path being at negative pressure. On the main wired board 51, this allows air to concentratedly flow especially through the region (in the vicinity of the gap G) of the circuit that causes the printing unit 3 to drive and generates heat. Thus, by making changes such as varying the width of the flow path using, for example, the gap G to cause the air to flow at an increased speed, it is possible to cool the circuit that causes the printing unit 3 to drive.

In the power-source-wired-board cooling unit 75 of the printing apparatus 1 according to the present exemplary embodiment, the power-source wired board 55 is a wired board that constitutes the power supply unit. In addition, the power supply fan 92 is disposed at the lower side of and on the front face side of the power-source wired board 55 disposed within the second flow path 78. With this configuration, the air discharged from the power supply fan 92 flows from the lower portion of the second flow path 78 toward the upper portion where the outlet 618 is formed. This causes the air to flow in a substantially diagonal manner from the lower portion on the front face side to the upper portion on the rear face side with respect to the power-source wired board 55, which makes it possible to cool the entire power-source wired board 55. Furthermore, the warmed air collected on the upper portion with respect to the outlet 614 disposed on the upper side is easily discharged to the outside from the outlet 614.

2. Modification Example

In the present exemplary embodiment, the wired-board fixing case 63, 66 includes a metal member. However, the wired-board fixing case 63 may be configured such that the wired-board fixing case 63 includes a metal member, and a heat-dissipating fin (not illustrated) is formed on a surface of the wired-board fixing case 63 on the first flow path 72 side. Similarly, the wired-board fixing case 66 may be configured such that the wired-board fixing case 66 includes a metal member, and a heat-dissipating fin (not illustrated) is formed on a surface of the wired-board fixing case 66 on the first flow path 76 side.

With such a configuration, it is possible to actively dissipate heat within the first flow paths 72 and 76, which makes it possible to further improve efficiency of cooling the main wired board 51 and the power-source wired board 55.

Below, details derived from the exemplary embodiment and the modification example will be described.

A printing apparatus includes, inside of a housing: a power-supply unit that serves as a driving source; a printing unit that performs printing to a sheet; a circuit board that causes the power-supply unit or the printing unit to drive; and a cooling unit that cools the circuit board, in which the cooling unit includes: an inflow portion including an inlet from which air outside of the housing flows in, the inlet being disposed on a rear face of the housing; a first flow path in which the air flowing in from the inlet flows on a front face side of the housing; a turn-around flow path that causes the air flowing in the first flow path to be turned around to a rear face side of the housing; a second flow path in which the air turned around in the turn-around flow path flows on the rear face side; a flow-out portion including an outlet from which the air flowing in the second flow path flows out to an outside of the housing, the outlet being disposed on the rear face; and a fan that causes the air to flow in from the inlet and also causes the air passing through the first flow path, the turn-around flow path, and the second flow path to flow out from the outlet, in which the circuit board is disposed within the second flow path.

According to this configuration, the cooling unit in the printing apparatus includes the inflow portion including the inlet from which air outside of the housing flows in, the inlet being disposed on the rear face of the housing, and also includes the flow-out portion including the outlet from which the air flowing in the second flow path flows out to an outside of the housing, the outlet being disposed on the rear face. In addition, there are provided: the first flow path in which the air flowing in from the inlet flows on the front face side of the housing; the turn-around flow path that causes the air flowing in the first flow path to be turned around to the rear face side of the housing; and the second flow path in which the air turned around in the turn-around flow path flows on the rear face side. Furthermore, there is provided the fan that causes the air to flow in from the inlet and also causes the air passing through the first flow path, the turn-around flow path, and the second flow path to flow out from the outlet.

With the cooling unit configured in this manner, it is possible to cool the circuit board of the printing apparatus. Thus, when the printing apparatus is installed on a shelf, it is possible to perform installation in a state where the printing apparatus is in contact with the side surface of the shelf located in the left-right direction. This makes it possible to minimize the installation space, thereby improving the degree of freedom in terms of installation, as compared to typical printing apparatuses in which an inlet is provided in a side surface of the printing apparatus, and when the printing apparatus is installed on a shelf, there is a constraint in which the printing apparatus needs to be installed so as to be spaced apart from the side wall of the shelf in the left-right direction, or the like.

Note that a small space needs to be given on the rear face side in order to allow a power supply cable or various types of cables to be installed. Cooling, however, can be performed using this open space.

Furthermore, in the printing apparatus, the cooling unit is configured such that the first flow path on the inlet side and the second flow path on the outlet side communicate to each other through the turn-around flow path in a turned-around manner. In addition, the circuit board is disposed within the second flow path. With the cooling unit as configured above, it is possible to cause heavy dust such as iron dust to fall down in the first flow path during the flow, when the entering air contains electrically conductive dust such as iron dust. Thus, the electrically conductive dust is less likely to flow through the circuit board disposed within the second flow path.

This makes it possible to suppress malfunction of circuits occurring due to attachment of electrically conductive dust, as compared to typical printing apparatuses in which malfunction occurs in circuits due to attachment of electrically conductive dust because air flowing in from an inlet is directly blown onto the circuit board to perform cooling.

In the printing apparatus described above, the first flow path and the second flow path may be separated by a fixing member that fixes the circuit board.

According to this configuration, it is possible to simply configure the first flow path and the second flow path using a simple member of the fixing member that fixes a circuit board. Thus, it is possible to configure the cooling unit in a compact manner.

In the printing apparatus described above, the fixing member may include a metal member.

This configuration allows part of heat generated in the circuit board to be transferred to the fixing member comprised of a metal member and be dissipated using air flowing through the first flow path, which makes it possible to improve efficiency of cooling the circuit board.

In the printing apparatus described above, a heat-dissipating fin may be formed on a surface, on a side of the first flow path, of the fixing member.

This configuration allows heat to be actively dissipated in the first flow path, which makes it possible to further improve efficiency of cooling the circuit board.

In the printing apparatus described above, the first flow path and the second flow path are isolated from the printing unit provided inside the housing.

With this configuration, the first flow path and the second flow path are isolated from the printing unit provided inside the housing. This prevents the heat generated in the circuit board from being transferred to the printing unit. Thus, the printing unit does not receive an effect of the heat, which makes it possible to maintain printing quality. In addition, it is possible to prevent a mist that is more likely to be generated during printing from being attached to the circuit board.

In the printing apparatus described above, the outlet may be provided at a position higher than the inlet.

With this configuration, the outlet is provided at a position higher than the inlet, which makes it possible to easily cause the warmed air to flow out from the outlet because warmed air is more likely to move upward.

In the printing apparatus described above, the circuit board may be a circuit board that causes the printing unit to drive, and the fan may be disposed inside the rear face on which the outlet is disposed.

With this configuration, the fan is provided inside the rear face where the outlet is provided, so as to correspond to a circuit board that causes the printing unit to drive. Thus, it is possible to set the inside of the flow path being at negative pressure. This allows air to flow especially through a region of the circuit board where heat is generated, and this also makes it possible to increase the degree of freedom in terms of air-flow at various flow speeds. Note that it is possible to cool a circuit board, for example, by narrowing a flow path in a region of the circuit that generates heat and causes the printing unit to drive, thereby causing the air to flow at increased speed. It is preferable to set the inside of the flow path to be under negative pressure in order to achieve the flow as described above.

In the printing apparatus described above, the circuit board may be a circuit board that constitutes the power-supply unit, and the fan may be disposed at a lower side of and on the front face side of the circuit board disposed in the second flow path.

With this configuration, the fan is provided at the lower side of and on the front face side of the circuit board disposed in the second flow path, thereby delivering air from the fan to the circuit board that constitutes the power-supply unit. This makes it possible to easily cause the warmed air collected on the upper side, to flow out to the outside from the outlet. In addition, since it is possible to cause the air to flow in a substantially diagonal manner with respect to the circuit board toward the outlet provided on the upper side, it is possible to cool the entire circuit board.

What is claimed is:

1. A printing apparatus comprising, inside a housing thereof:

a power-supply unit configured to serve as a driving source;

a printing unit configured to perform printing onto a sheet;

a circuit board configured to drive the power-supply unit or the printing unit; and a cooling unit configured to cool the circuit board, wherein the cooling unit includes:

an inflow portion including an inlet from which air outside of the housing flows in, the inflow portion being disposed at a rear surface of the housing;

a first flow path in which the air flowing in from the inlet flows to a front surface side of the housing;

a turn-around flow path causing the air flowing through the first flow path to be turned around to a rear surface side of the housing;

a second flow path in which the air turned around in the turn-around flow path flows to the rear surface side;

a flow-out portion including an outlet from which the air flowing through the second flow path flows out to an outside of the housing, the flow-out portion being disposed at the rear surface; and a fan causing the air to flow in from the inlet and also causing the air, which passes through the first flow path, the turn-around flow path, and the second flow path, to flow out from the outlet, wherein the circuit board is disposed within the second flow path, wherein the first flow path and the second flow path are separated from each other by a fixing member that fixes the circuit board, the fixing member is formed of a metal member, and a heat-dissipating fin is formed at a surface of the fixing member at the first flow path side.

2. The printing apparatus according to claim 1, wherein the first flow path and the second flow path are isolated from the printing unit provided inside the housing.

3. The printing apparatus according to claim 1, wherein the outlet is provided at a position higher than a position of the inlet.

4. The printing apparatus according to claim 1, wherein the circuit board is a circuit board that constitutes the power-supply unit, and the fan is disposed at a lower side of the circuit board, which is disposed in the second flow path, at the front face side.

5. A printing apparatus comprising, inside a housing thereof:

a power-supply unit configured to serve as a driving source;

a printing unit configured to perform printing onto a sheet;

a circuit board configured to drive the power-supply unit or the printing unit; and a cooling unit configured to cool the circuit board, wherein the cooling unit includes:

an inflow portion including an inlet from which air outside of the housing flows in, the inflow portion being disposed at a rear surface of the housing;

a first flow path in which the air flowing in from the inlet flows to a front surface side of the housing;

a turn-around flow path causing the air flowing through the first flow path to be turned around to a rear surface side of the housing;

a second flow path in which the air turned around in the turn-around flow path flows to the rear surface side;

a flow-out portion including an outlet from which the air flowing through the second flow path flows out to an outside of the housing, the flow-out portion being disposed at the rear surface; and a fan causing the air to flow in from the inlet and also causing the air, which passes through the first flow path, the turn-around flow path, and the second flow path, to flow out from the outlet, wherein the circuit board is disposed within the second flow path, and the fan is disposed at an inner side of the rear surface in which the outlet is disposed.

6. The printing apparatus according to claim 5, wherein the circuit board is a circuit board configured to drive the printing unit.

7. The printing apparatus according to claim 5, wherein the circuit board is a circuit board configured to drive the power-supply unit.

* * * * *